US006036538A

United States Patent [19]

Lin

[11] Patent Number: 6,036,538

[45] Date of Patent: Mar. 14, 2000

[54] SECURING MECHANISM USED IN MINIATURE CHRISTMAS LIGHT BULB SOCKETS

[76] Inventor: Fong Shi Lin, No. 196, Chin Long Road, Hsio Chin Ko Chang, Kwei Chou City, KaunTon, Taiwan

[21] Appl. No.: 09/198,258

[22] Filed: Nov. 24, 1998

[51] Int. Cl.[7] ..... H01R 13/60

[52] U.S. Cl. ..... 439/574; 362/249

[58] Field of Search ..... 439/574, 575, 439/453; 362/249, 252, 806; D26/25; 248/214, 227.4, 230.3, 230.5, 231.61

[56] References Cited

U.S. PATENT DOCUMENTS

| | | | |
|---|---|---|---|
| 3,321,730 | 5/1967 | Schlangen | 439/575 |
| 4,657,331 | 4/1987 | Coldren | 439/357 |
| 4,708,413 | 11/1987 | Schroeder | 439/358 |
| 5,121,310 | 6/1992 | Ahroni | 362/238 |
| 5,526,246 | 6/1996 | Liou | 362/252 |
| 5,626,419 | 5/1997 | Lin | 362/391 |

*Primary Examiner*—Lincoln Donovan
*Assistant Examiner*—Hae Moon Hyeon
*Attorney, Agent, or Firm*—Rosenberg, Klein & Lee

[57] ABSTRACT

A securing mechanism used in Christmas light bulb series mainly comprises a light bulb socket having a pair of longitudinal guide rails formed on two side wall surface thereof and a plurality of transverse ribs disposed between two guide rails. The transverse ribs have a triangular cross section with an inclined top side and a horizontal bottom side. The securing mechanism also includes a U-shaped fastener that has horizontal locking ribs disposed on the inner wall surfaces on two ends thereof. The locking ribs have a cross section with a horizontal top side and an inclined bottom side. The fastener mounts on a support frame and holds on two sides of the socket to secure and locate a socket at arbitrary position along the support frame with a desired inclination angle.

7 Claims, 5 Drawing Sheets

SECURING MECHANISM USED IN MINIATURE CHRISTMAS LIGHT BULB SOCKETS

BACKGROUND OF THE INVENTION

Most of the Christmas light bulb strings achieve their decorative purpose by means of hanging. To enhance their attraction and show their uniqueness, usually the light bulb strings hang on a support frame with special shapes like characters or design patterns. Thus, the light bulb strings display, after being powered, the character or pattern of the support frame. The conventional method uses simply a hanging connection, without effective fixation. That arrangement often leads to loosening. Furthermore, the loosened light bulbs make the pattern or character appear to be incomplete. It is therefore desirable to improve the conventional structure.

SUMMARY OF THE INVENTION

In view of the foregoing problems, the primary object of the present invention is to provide a securing mechanism for Christmas light bulb sockets that employs a specially designed locking means to overcome the deficiency of conventional light bulb strings.

Now the features and advantages of the present invention will be described below in detail with reference to the accompanying drawings.

DETAILED DESCRIPTION OF THE PREFERRED EMBODIMENTS

Figure 1:
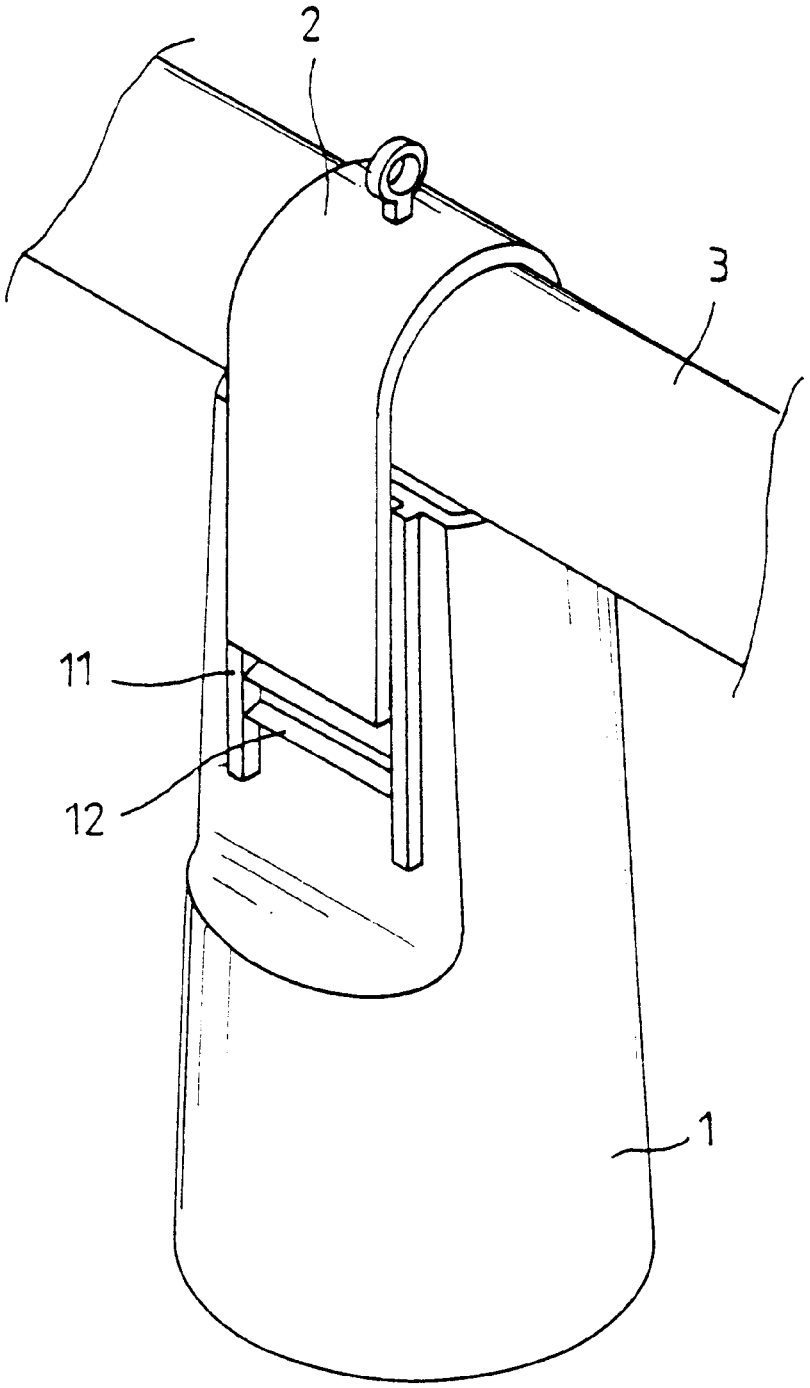
FIG. 1 is a perspective view showing a miniature light bulb socket according to the present invention.
Figure 2:
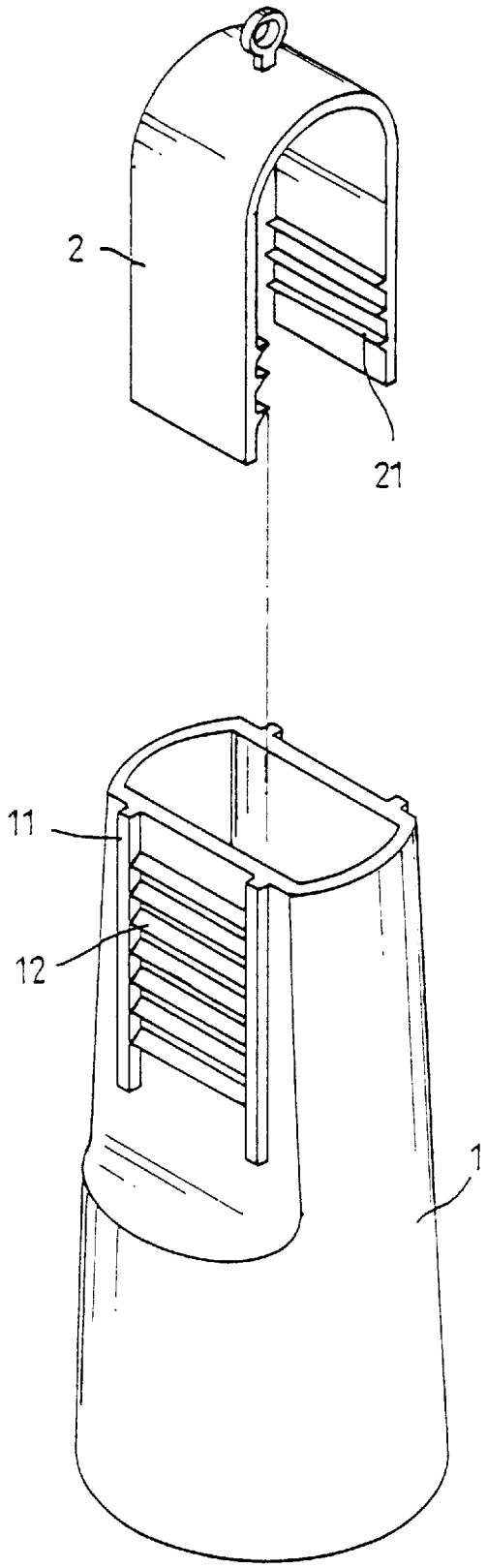
FIG. 2 is an exploded view illustrating the securing means of the socket of FIG. 1.
Figure 3:
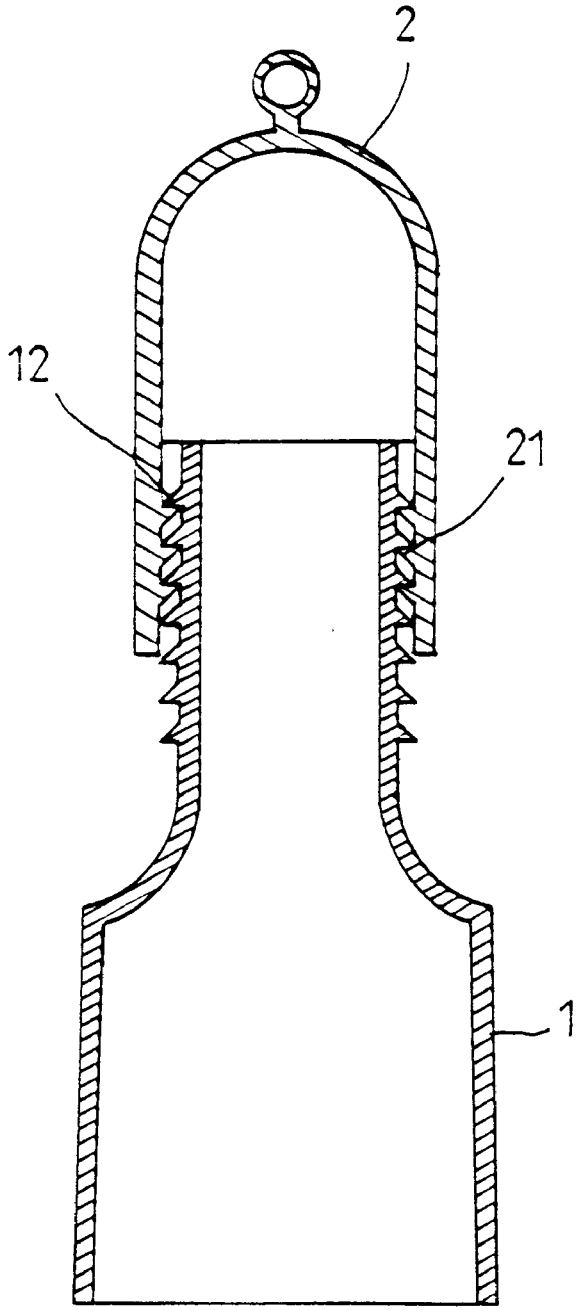
FIG. 3 is a cross sectional view of the socket assembly according to the present invention.

With reference to the accompanying drawings, the present invention comprises a miniature light bulb socket 1 and a fastener 2. A light bulb holder receiving a light bulb therein (not shown) is inserted into the socket 1, which is similar to the conventional method and thus will not be explained in further detail. The socket 1 is provided with a pair of longitudinal guide rails 11 and a plurality of horizontal transverse ribs 12 between the two guide rails 11 on each of two sides of the socket 1. Each transverse rib 12 has a triangular cross section with an inclined top side and a horizontal bottom side. The fastener 2 has a U-shaped resilient body with horizontal locking ribs 21 formed on two inner wall surfaces, which ribs also have a triangular cross section with a horizontal top side and an inclined bottom side.

In use, the U-shaped fastener 2 extends over a decorative support frame 3 with the two side ends thereof respectively extending between the two longitudinal guide rails 11 on each of two sides of light bulb socket 1. In the meantime, the locking ribs 21 of the fastener 2 interlock with the transverse ribs 12 of the socket 1 under the resilient restoring force of the fastener 2 to form a firm attachment. With such an arrangement, the socket 1 can be disposed at any position along the support frame 3 with a desired inclined angle. Thus, the socket 1 can achieve an expected effect by maintaining its location. A Christmas light bulb string with all of the sockets having such securing means can be easily attached to a support frame, providing an optimal decorative effect.

The foregoing configuration of transverse ribs 12 and locking ribs 21 can facilitate a quick unidirectional engagement between a fastener 2 and a socket 1, which is not easy to separate due to the restoring force of the resilient sides of the fastener. In addition, the two longitudinal rails 11 on each of two sides of socket 1 confine the respective sides of the U-shaped fastener 2, so that the fastener 2 is not movable.

Figure 4:
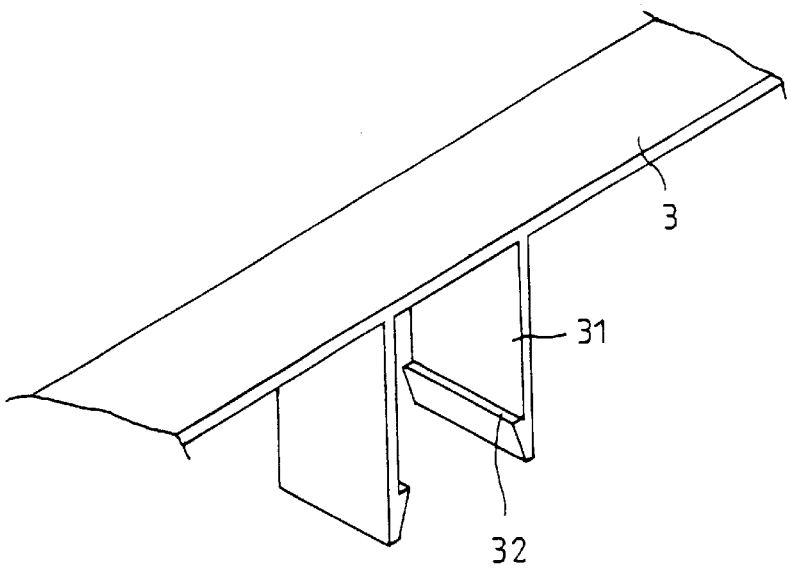
FIG. 4 shows a second embodiment of the securing means according to the present invention.
Figure 4:
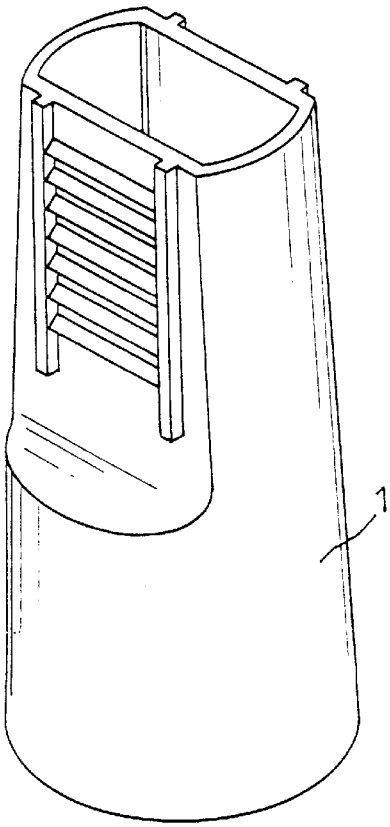
Figure 5:
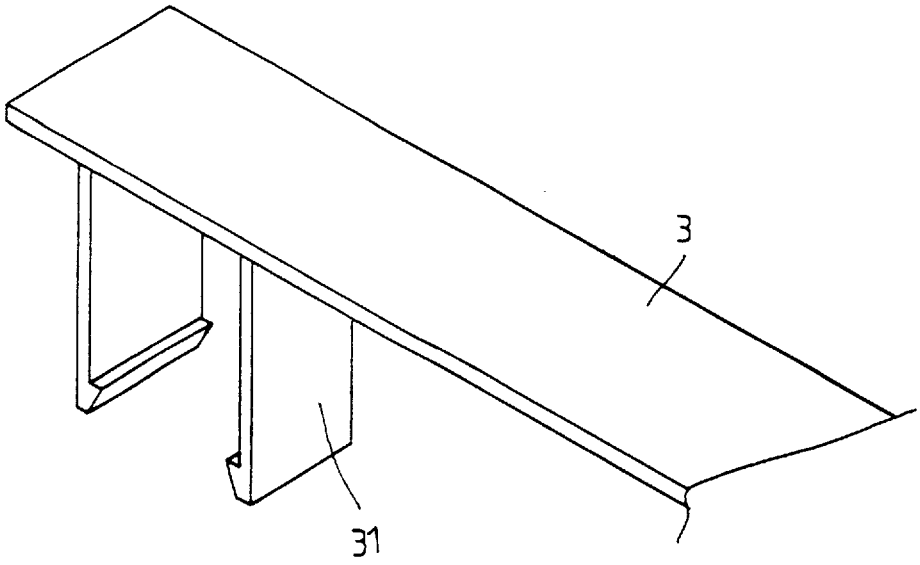
FIG. 5 shows a third embodiment of the securing means according to the present invention.
Figure 5:
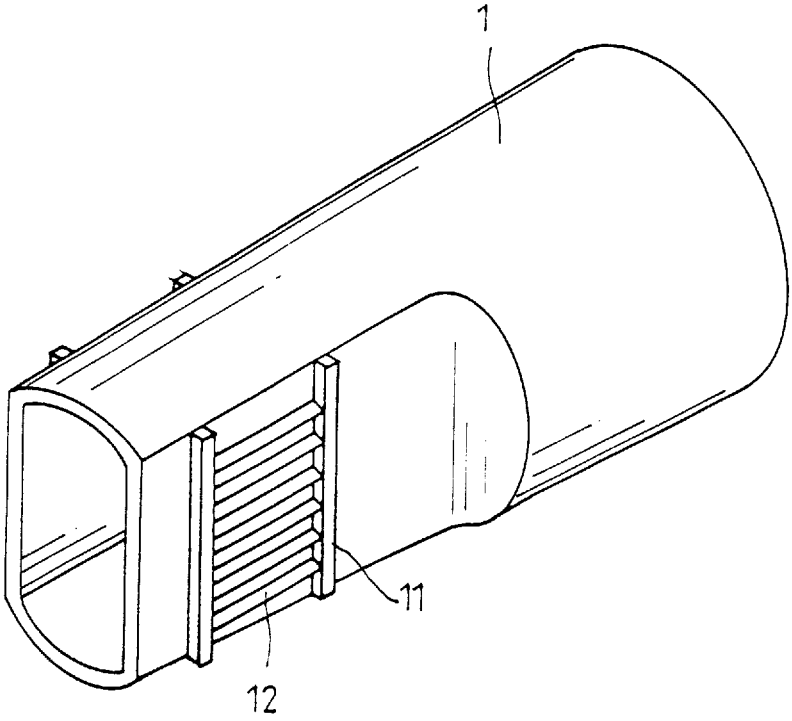

The support frame 3 may include two parallel locking plates 31 formed on one side surface of support frame 3, as shown in FIG. 4. The parallel locking plates hold on to the socket 1 by means of hook portions 32 formed on the free end of each locking plate for locking engagement with the transverse ribs 12 of the socket 1. Consequently, that arrangement can obtain the same securing effect as the first embodiment. FIG. 5 shows another embodiment of the securing mechanism, in which the guide rails and the transverse ribs are disposed in a direction perpendicular to the previous example. By that arrangement, the light bulb on the socket faces toward one side. This will enhance the illumination effect.

What is claimed is:

1. A mechanism for securing a miniature Christmas light bulb socket to a support frame, comprising:

a longitudinally extended miniature light bulb socket having a pair of opposing side wall surfaces adjacent a distal end of said socket, each of said side wall surfaces having a pair of spaced parallel guide rails and a plurality of ribs extending orthogonally between said guide rails; and, a fastener having a U-shaped resilient body with a pair of elongated side portions adapted for receiving the support frame and said distal end of said socket therebetween, each of said side portions having a plurality of locking ribs formed on an inner wall surface for respective engagement with said plurality ribs on a respective side of said socket to define an assembly that is angularly positionable about the support frame.

2. The mechanism for securing as recited in claim 1, wherein said plurality of ribs extend longitudinally between said guide rails and said socket thereby extends orthogonally with respect to said side portions of said fastener.

3. The mechanism for securing as recited in claim 1, wherein said plurality of ribs extend transversely between said guide rails and said socket thereby extends in linearly aligned relationship with respect to said side portions of said fastener.

4. A securing mechanism for miniature Christmas light bulb sockets, comprising:

at least one longitudinally extended miniature light bulb socket having a pair of opposing side wall surfaces adjacent a distal end of said socket, each of said side wall surfaces having a pair of spaced parallel guide rails and a plurality of ribs extending orthogonally between said guide rails; and, an elongated support frame having at least one fastener integrally formed thereon for coupling to said at least one socket, said at least one fastener having a pair of spaced parallel locking plates for receiving said distal end of said at least one socket therebetween, each of said locking plates having a locking rib formed on an inner wall surface for engagement with one of said plurality ribs on a respective side of said at least one socket to couple said at least one socket to said support frame.

5. The securing mechanism as recited in claim 4 where said plurality of ribs extend transversely with respect to the light bulb socket.

6. The securing mechanism as recited in claim 4 where said plurality of ribs extend longitudinally with respect to the light bulb socket.

7. A securing mechanism for miniature Christmas light bulb sockets, comprising:

at least one longitudinally extended miniature light bulb socket having a pair of opposing side wall surfaces adjacent a distal end of said socket, each of said side wall surfaces having a pair of spaced parallel guide rails extending transversely and a plurality of ribs extending longitudinally between said guide rails; and, an elongated support frame having at least one fastener integrally formed thereon for coupling to said at least one socket, said at least one fastener having a pair of spaced parallel locking plates extending longitudinally for receiving said distal end of said at least one socket therebetween, each of said locking plates having a transversely directed locking rib formed on an inner wall surface for engagement with one of said plurality ribs on a respective side of said at least one socket to secure said at least one socket orthogonally with respect to said locking plates.

* * * * *